United States Patent [19]

Bradley

[11] Patent Number: 4,530,731

[45] Date of Patent: Jul. 23, 1985

[54] HIGH SPEED METHOD OF MAKING ENVELOPES EACH WITH A SEPARATE ENCLOSURE

[75] Inventor: William P. Bradley, Hollidaysburg, Pa.

[73] Assignee: Bedford Engineering Co., Armonk, N.Y.

[21] Appl. No.: 568,547

[22] Filed: Jan. 5, 1984

[51] Int. Cl.[3] ..... B65B 11/48

[52] U.S. Cl. ..... 156/227; 156/250; 282/25; 493/216; 493/223; 493/228; 493/231

[58] Field of Search ..... 493/216, 223, 224, 228, 493/227, 231; 283/1 B; 282/25; 53/206, 460

[56] References Cited

U.S. PATENT DOCUMENTS

| | | | |
|---|---|---|---|
| 1,591,231 | 7/1926 | Otis | 282/25 |
| 3,557,519 | 1/1971 | Lyon | 493/216 |
| 4,091,596 | 5/1978 | Jones | 53/460 |
| 4,189,895 | 2/1980 | Volkert et al. | 53/206 |
| 4,411,643 | 10/1983 | Higginson | 493/216 |

*Primary Examiner*—Caleb Weston

*Attorney, Agent, or Firm*—Herman J. Hohauser

[57] ABSTRACT

An improved high speed method for producing quantities of discrete envelope assemblies, each assembly including an envelope and separate enclosure formed from the same blank of sheet material and having personalized information printed on both the envelope and enclosure that is unique to each assembly.

The method provides for continuous operation of the method steps all occurring one after the other as each assembly travels in the same general direction throughout all processing operations.

15 Claims, 9 Drawing Figures

HIGH SPEED METHOD OF MAKING ENVELOPES EACH WITH A SEPARATE ENCLOSURE

BACKGROUND OF THE INVENTION

1. Field of the Invention

The invention generally relates to the high speed manufacture of mailing assemblies each of which includes a personalized envelope and separate similarly personalized enclosures formed from the same sheet material.

2. Description of the Prior Art

High speed web lithographic printing techniques have given rise over the past few decades to exponential increases in the use of direct mail advertising, this practice having further expanded more recently to include "personalized" letters produced through utilization of computer-controlled printing equipment capable of addressing a letter and even providing personal information previously stored in computer memory. Such prior techniques have expanded the use of direct mail advertising and similar communication by allowing mass mailings to be performed at an extremely low cost relative to previous manual methods. The personalization of mail effectively increases the return to the advertiser or other user. However, the personalization provided to such a letter by this relatively new technology has diminished in impact due to the nature of the envelopes and similar articles onto which the personalized information is printed. Personalized mailings lose a substantial amount of personal value when the person receiving the mailing can easily recognize the mailing as a "form" or "mass" mail advertisement, such poorly-produced mailings being often not opened or read by the recipient even though useful and valuable information is contained in the mailing. The use of "computer print-out" papers wherein an envelope and "letter" are combined together without detachment and often without even removal of edge perforations remaining from printing from a roll further increases the resistance of a recipient to seriously consider such a mailing as personal mail deserving of close attention. Numerous attempts to improve upon the impersonal "personalized" letter have been made in the art such as is evidenced by U.S. Pat. No. 3,557,519 to Lyon, Jr., who describes an integral envelope-letter article intended to provide the effect of a personal letter while retaining the ability to produce such letters in sufficient quantities to be economical within the economic framework of direct mail advertising. As a further example, Jones, in U.S. Pat. No. 4,091,596, provides a method for produring a mailing piece formed of an envelope and an insert. However, the Jones mailing piece is formed of two separate sheets of material blanked from different webs at different locations and mated in an assembly operation, such methodology being logistically difficult and of a speed which is becoming unacceptable in the industry due to cost considerations. Jones particularly provides two changes of direction in the manufacture of the mailing piece so disclosed, a first change of direction occurring on insertion of the separate "letter" portion of the mailing piece into an unglued blank with a second change of direction occurring to facilitate application of adhesive to the envelope blank which is followed by folding and sealing of the mailing piece. Changes of direction in such a processing operation inherently increase the time required for manufacture of a mailing piece. Volkert et al, in U.S. Pat. No. 4,189,895, provides a further example of the manufacture of mass mailing pieces which can be computer-personalized. Volkert et al provide an envelope containing a personalized enclosure which is unattached to the personalized envelope, the envelope and enclosure being formed from the same web of sheet material which has been preprinted. Volkert et al do not provide a mechanism within the mailing piece itself during formation which ensures that the envelope and enclosures are maintained in association with each other during folding and severing operations necessary to cause the envelope and enclosure to become separate entities.

Accordingly, it has become highly desirable to produce personalized mailing pieces consisting of a personalized envelope and a separate personalized enclosure which are formed from the same preprinted blank of sheet material and which particularly gives the effect of an important, personalized letter or other communication such as a telegram or the like. Further, it is particularly necessary in the production of such mailing pieces that the mailing pieces be produced at a high rate of speed in order that economies can be effected without diminution of the personalized quality of the mailing. The present invention addresses these needs by formation of a personalized mailing assembly comprised of an envelope and separate enclosure which can be produced in large quantities and at extremely rapid rates of production, thereby allowing the cost of a high personal impact mailing to be produced at a relatively low cost.

SUMMARY OF THE INVENTION

The present invention provides a particular improved method and a variation of the method for producing mass high speed extremely large quantities of discrete mailing assemblies including an envelope and a separate personalized enclosure formed from the same blank of sheet material. The invention further contemplates the "personalization" of both the envelope and enclosure by preprinting of the blank of sheet material prior to any operational procedures.

The personalized sheet material may be brought to the site of performance of the improved methods in various forms. In the preferred embodiment stacks of pre-cut pieces of sheet material referred to as blanks are provided. Each blank consists of a single thickness of sheet material such as paper or the like and include portions that will eventually be formed into an envelope and separate enclosure. An alternative to the use of pre-cut blanks includes the provision of a continuous roll or equivalent length of sheet material which is cut into single thickness sheets or blanks and personalized with appropriate indicia.

Each blank is transported one at a time at extremely high speed to the first of eight basic operational stations. At that station the blank is subjected to perforation or other equivalent operation such as scoring or the like so as to precisely define the junction of the envelope portion of the blank and enclosure portion of the blank.

After the perforation line is applied the blank is transported to the second station where it is then folded along such line to form a double thickness of sheet material. One thickness of material is the envelope portion and the other is the enclosure portion.

The third operational procedure is the application of adhesive material to the area of the blank that is referred to as the seal flap of the envelope portion. At the next operational or fourth station the material immediately adjacent both sides of the perforation line of the blank is severed resulting in the separation of the envelope portion from the enclosure portion so that the once single piece of sheet material is then two separate sheets, the envelope sheet and enclosure sheet, maintained in a double thickness configuration.

The once blank mailing assembly, now double layer, two sheet assembly is then transported to the fifth or scoring station at which location four separate score lines are applied to the envelope sheet. One of the four scorelines is simultaneously applied to the enclosure sheet and defines on the enclosure sheet the location at which the enclosure will subsequently be folded inside the envelope. Two of the four scorelines on the envelope sheet serve to define the two side flaps of the to-be-formed envelope. The third scoreline on the envelope sheet defines the seal flap of the to-be-formed envelope. The fourth scoreline is formed at the location of the envelope sheet that is to become the bottom closed edge of the envelope. This fourth scoreline and the scoreline applied to the enclosure sheet are located next to each other as the two sheets lie one upon the other in the double thickness of sheet material configuration.

The entire mailing assembly consisting of the double layer of the now separated envelope and enclosure sheet material is moved to the sixth or side-flap folding station. The side flaps of the envelope sheet are folded along the two side flap scorelines such they lie flat against the main portion of the envelope sheet and adjacent to and substantially in the same plane as the enclosure sheet so that there is no more than a double thickness of sheet material.

At the seventh operational location adhesive material is applied to the exposed surfaces of the two side flaps of the envelope sheet. Thereafter, the entire mailing assembly is transported to the eighth station whereupon both the envelope sheet and enclosure sheet are simultaneously folded along the respective scorelines so that the entire enclosure sheet becomes entirely disposed within the envelope sheet. The appropriate edges of the envelope sheet are sealed to the adhesive of the side flaps after the folding resulting in a completely formed envelope with the seal flap open and a separate folded enclosure located therein.

It is significant to note that as the mailing assembly is transported from the fourth operational station to the fifth through eighth operational stations the then separated envelope sheet and enclosure sheet remain in close contact with each other and do not move relative to each other during the process steps. It is also significant and most important to understand that during the entire process starting from the first perforation operation to the eighth folding operation the travel of the mailing assembly, initially as a one piece blank and then as a double-thickness two sheet assembly, is continuous and consistently in the same general direction. That is, as the blank is moved from one location to the next it never stops and always advances in the same advancing direction much like the operation of a conveyor belt system. This feature is unlike the operation of other systems wherein folding is accomplished by transporting the work product at sharp angles to the general direction of travel of such work product. Because the direction of travel is singular and continuous extremely high speeds of operation is attained resulting in the production of large quantities of mailing assemblies in a relatively short time period.

Accordingly, it is an object of the present invention to provide a method for producing quantities of discrete envelope assemblies including at least one enclosure which is separate from the envelope, the envelope assemblies being produced at extremely high speeds from a preprinted web of sheet material with the web of sheet material and elements severed from the web traveling in a singular direction throughout manufacture.

It is another object of the invention to provide a method for producing large quantities of mailing pieces formed of separate envelopes and enclosures and wherein the envelope and enclosure is formed from the same sheet of material and which allows the marking of both the envelope and enclosure with indicia which can be unique to each mailing piece.

Further objects and advantages of the invention will become more readily apparent in light of the following detailed description of the preferred embodiment.

DESCRIPTION OF THE PREFERRED EMBODIMENTS

Figure 1:
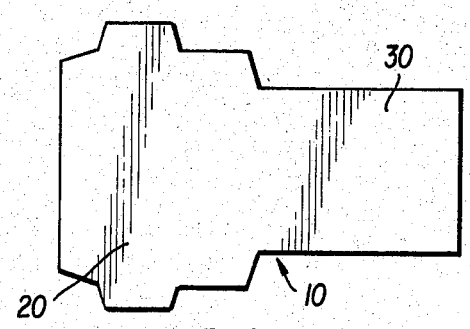
FIG. 1 is a schematic view of a single pre-cut blank from which an envelope with separate enclosure is formed prior to any of the inventive processing operations being performed.

Referring now to the drawing, a preferred method of the invention is schematically illustrated for ease of understanding the basic steps by which the invention allows extremely rapid production of personalized mailing pieces configured in accordance with the structure of the article of the invention. A single blank 10 of pre-cut paper material is seen in FIG. 1. It is to be understood that the blank 10 can be transported from a stack of such blanks or formed from a continuous paper web that can be produced by conventional computer-controlled lithography technology.

In the instance that the blank 10 is formed from a continuous paper web such web is typically brought to the site of performance of the present methods in a roll-like conformation. The web is fed from the roll or other storage configuration and onto apparatus capable of providing the particular method steps of the invention. A description will not be provided of the particular appartus employed since the apparatus can take a variety of forms and can involve modification of conventional apparatus, which modification becomes apparent in view of the teachings herein provided. For these reasons and for simplicity of description, particular apparatus will not be described within the context of the present application for patent.

The web is provided prior to practice of the present methods with personalized information and with any additional printing necessary to convey the intended communication. In particular, the web preferably contains an essentially one thickness of sheet material portions which will eventually be formed into individual envelopes and enclosures to be contained within said envelopes. The portions of the web which are intended to be formed into the envelope portions and the portions of said web which are to be formed into the enclosures or "letter" portions are predetermined by the prior printing of the personalization indicia and by the other indicia forming the communication, design and the like. Accordingly, the web is initially fed into a cutting unit (not shown) and is photo-optically registered by means of a conventional optical registering device (not shown). As the web is fed into the cutting unit, conventional cutting structure (not shown) provide contour cuts, typically on both side edges of the web, essentially identical cuts being periodically made into the web. As can be understood from the foregoing, the mention hereinafter of structure used to perform the various operations upon the web and the web portions eventually created are not shown for purposes of simplicity and are not considered to be a part of the instant invention.

In the instance wherein the blank 10 is transported from a stack of pre-cut blanks it is to be understood that such stack is brought to the site of performance of the present methods. Each pre-cut blank 10 consists of a single thickness sheet of material, usually paper or the like, which will eventually be formed into an individual envelope and separate enclosure. The envelope and enclosure will contain individualized and personalized information generally in the form of the printing of the name and address of a proposed recipient but may include other personalized information. This invention is not concerned with how or when the information is printed on the blanks. In some instances the individualized information will be already printed on each blank before the stack of blanks are brought to the site of the performance of this inventive process.

Whether the individual blank 10 is formed from a web or brought to the performance site included in a stack of many other pre-cut blanks with different personalized indicia it is to be understood that the process converting such blank into an envelope with a separate insert both including the "personalized" information is accomplished via the use of a modified conventional envelope machine in which standard and well-known procedures are re-arranged to result in the inventive process. For that reason disclosure of such conventional "hardware" is not deemed to be necessary. Reference can be made to the patents discussed in the above description of the prior art wherein many of the operations are disclosed and explained. Reviewing those patents and others in the prior art it can be appreciated that such operations such as folding, scoring, perforating, adhesive application and cutting can be done in any of several conventional ways. The procedural order of these operational steps in the instant system is the significant aspect of this invention. Accordingly, the following detailed description will not include explanation of the particular apparatus used to accomplish various operations on the sheet material. Further, the detailed description will explain all operational steps on a single blank. It is to be understood that the same operational procedures will be applied to other blanks continuously one after another in extremely rapid succession. Still further, it is to be understood that each blank during the course of all the operations being applied to it will travel in the same general direction throughout the entire process. For purposes of simplicity and clarity mention will not hereinafter be made of the fact that the particular operational apparatus is not shown.

Referring again to FIG. 1 blank 10, a pre-cut single sheet of material, generally of paper like quality, is seen to include an envelope portion 20 and an enclosure portion 30. The envelope portion 20 and the enclosure portion 30 of blank 20 both include the "personalized" information necessary for the mailing piece. Other blanks will have differing personalized information printed thereon in those situations requiring personalization.

Figure 2:
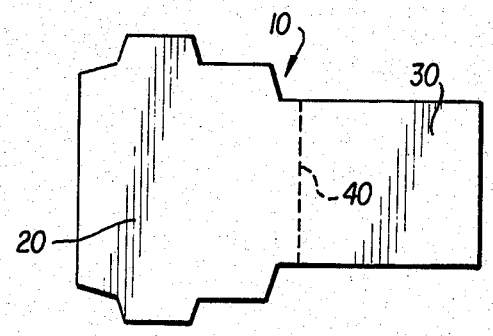
FIG. 2 is a schematic view of the blank after the first processing step consisting of the application of a perforation line has been accomplished.

Blank 10 is moved to the first station and is there subjected to a perforation operation. As can be seen in FIG. 2 a perforation line 40 is formed on blank 10 at the juncture of the envelope portion 20 and adjacent enclosure portion 30. The perforation line 40 on blank 10 thus serves to substantially define that portion 20 of the blank 10 which becomes the envelope from that portion 30 of the blank 10 which becomes the enclosure.

While a perforation operation is preferred it is possible to use other operational procedures known in the art to provide a functional equivalent to the perforation line. For example, the blank 10 could be subjected to a scoring operation to result in a scoreline in lieu of the perforation line 40. The use of other equivalent operations in this regard is considered beyond the scope of this invention and hereinafter, the reference to perforating can be taken to include scoring or other similar operations.

Figure 3:
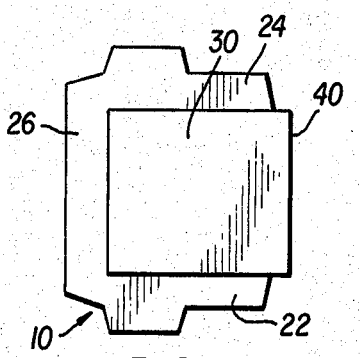
FIG. 3 is a schematic view of the blank after the second processing step consisting of the folding of the blank along the perforation line.

After the perforation line 40 is applied, blank 10 is transported in the same direction to a folding station at which time the enclosure portion 30 is folded over the envelope portion 20 along the perforation line 40. After this folding operation the blank 10 consists of a double thickness of sheet material. In the folded condition enclosure portion 30 substantially covers envelope portion 20. As can be seen in FIG. 3 side edge areas 22 and 24 and seal flap edge area 26 are the only areas that are not covered by enclosure portion 30.

Figure 4:
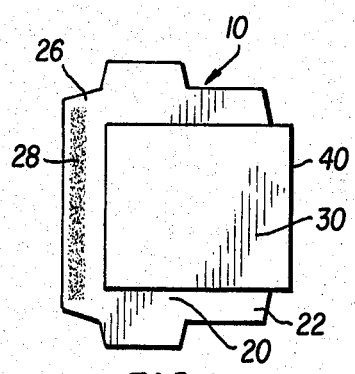
FIG. 4 is a schematic view of the blank after the third processing step consisting of the application of adhesive material.

Once blank 10 is in the folded condition shown in FIG. 3 it is transported to the next operation at which time adhesive material is applied. Referring to FIG. 4 it is seen that adhesive material 28 is then located only on a portion of flap edge area 26. The adhesive 28 may be any known gumming material conventionally used in the envelope making industry and is not per se considered to be part of the inventive system. It is noted that the direction of travel of blank 10 from the folded condition of FIG. 3 to the application of adhesive station is the same as the previous direction of travel of blank 10 and that the movement of blank 10 in the actual process remains continuous.

Figure 5:
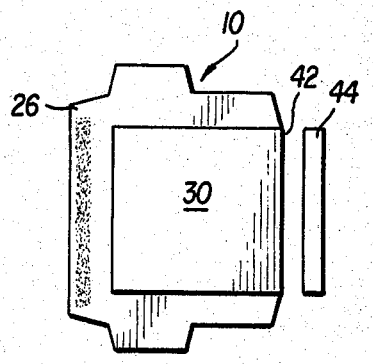
FIG. 5 is a schematic view of the blank after the fourth processing step consisting of the severing operation.

The next operational step involves the shearing or cutting of a substantially rectangular portion 44 from the folded blank 10 at location 42 (see FIG. 5). Portion 44 is essentially a small quantity of sheet material which includes strips from both the envelope portion 20 and enclosure portion 30 on each side of the perforation line 40. In other words, the shearing operation removes the sheet material from blank 10 connecting the envelope portion 20 and enclosure portion 30 on each side of the perforation line 40. After the shearing operation, the envelope portion 20 is no longer integral with the enclosure portion 30. It is to be noted, however, that the now separated portions 20 and 30 of blank 10 remain in position relative to each other during the course of the next three operations as will be explained in more detail below. Since portions 20 and 30 are separated hereinafter they will be referred to as envelope sheet 20 and enclosure sheet 30 respectively.

Figure 6:
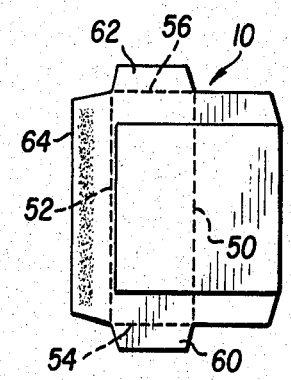
FIG. 6 is a schematic view of the blank after the fifth processing step consisting of the application of score lines.

Upon being transported from the shearing operation sheets 20 and 30 become scored as can best be seen in FIG. 6. Four separate score lines 50, 52, 54 and 56 are applied in the locations shown. Score line 50 is applied to both enclosure sheet 30 and envelope sheet 20 while the score line 52, 54 and 56 are placed on only the envelope sheet 20. It should be apparent that the scorelines may be applied all at once, one at a time in various sequence or other combinations of two or more at a time. In the preferred embodiment score lines 50 and 52 are simultaneously applied before scorelines 54 and 56 which are also simultaneously applied.

Score line 50 located on envelope sheet 20 serves to define the bottom edge of the to be formed envelope while the same score line 50 located on enclosure sheet 30 serves to define the line upon which the enclosure sheet 30 is eventually folded as will be explained below. Score line 52 serves to define seal flap 64 located on seal flap area 26 of envelope sheet 20. Score lines 54 and 56 serve to substantially define those portions of side edge areas 22 and 24 respectively of envelope sheet 20 that are the side flaps 62 and 64 respectively of the to be formed envelope.

Figure 7:
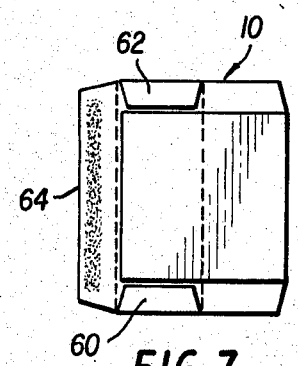
FIG. 7 is a schematic view of the blank after the sixth processing step consisting of the folding of the side flaps of the envelope sheet.

After the scorelines 50, 52, 54 and 56 are applied sheets 20 and 30 are moved to the next operational station at which location side flaps 60 and 62 are folded as shown in FIG. 7 along score lines 54 and 56 respectively. Thereafter the entire assembly comprised of envelope sheet 20 and enclosure sheet 30 is transported to an adhesive application station where adhesive material 70 and 72 are applied to the exposed surfaces of side flaps 60 and 62 respectively as is shown in FIG. 8.

Figure 8:
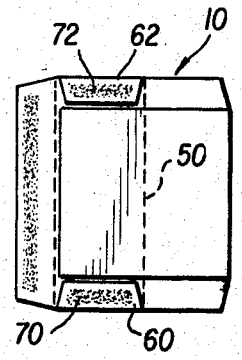
FIG. 8 is a schematic view of the blank after the seventh processing step consisting of the application of adhesive material to the side flaps of the envelope sheet.
Figure 9:
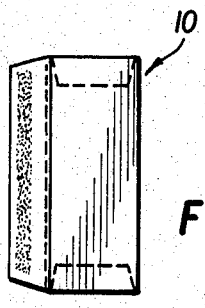
FIG. 9 is a schematic view of the blank after eighth processing step consisting of the folding and sealing of the envelope.

Subsequent to the adhesive application to side flaps 60 and 62 the portions of envelope sheet 20 and enclosure sheet 30 located to the right of scoreline 50 as viewed in FIG. 8 are folded simultaneously along scoreline 50 so that the entire enclosure sheet 30 at the next operational station as shown in FIG. 9. It will be appreciated that the side edge areas 22 and 24 of envelope sheet 20 located to the right of score line 50 (as viewed in FIG. 8) comes into contact with adhesive material 70 and 72 respectively to form a complete envelope with the enclosure sheet 30 completely covered and disposed therein for easy removal.

The present invention thus provides methods for high speed manufacture of discrete envelope assemblies or mailing pieces comprised of personalized envelopes and enclosures which are separate from each other in final assembly but which are formed from the same web of preprinted sheet material. The present methods particularly allow the continuous, high speed manufacture of personalized mailing pieces in large volumes and at relatively low cost. It is to be further stressed that the ability of the present methodology to be practiced at high speeds derives in part from the fact that all the direction of travel of the blank 10 from the first to last processing operation occurrs in the same general direction as explained above. It is further understood that the invention can be practiced other than as is explicitly described herein, the scope of the invention being defined by the appended claims.

What is claimed is:

1. An improved high speed method for producing a plurality of mailing assemblies each such mailing assembly comprised of an envelope and an enclosure consisting of the following steps:

a. providing a plurality of blanks of sheet material with each blank being comprised of an envelope portion having at least two flap sections and an enclosure portion;
b. separating said plurality of blanks one at a time so that formation of each into an envelope with an enclosure can be accomplished rapidly one after the other;
c. folding said enclosure portion of a single blank upon said envelope portion of said blank to form a double thickness of sheet material with said enclosure portion covering substantially all of said envelope portion with the exception of three edges of said envelope portion;
d. applying adhesive on a predetermined area of said envelope portion;
e. separating said enclosure portion from said envelope portion of each blank to form two discrete pieces and retaining said double thickness of material;
f. folding said two flap sections of said envelope portion not covered during the step c. folding step; and
g. folding said double thickness of sheet material so that at least two edges of said envelope portion are sealed to form an envelope assembly having an enclosure.

2. The method of claim 1 further comprising the step of perforating each blank after step b. and before step c. to form a perforated line dividing said envelope portion from said enclosure portion.

3. The method of claim 2 wherein the manufacturing steps proceed in the same direction of travel throughout the mailing assembly production operation.

4. The method of claim 2 wherein adhesive is applied on said two flap sections of said envelope portion after step f. and before step g.

5. The method of claim 2 wherein in step f. said two flap sections are folded on the same side of the remaining section of said envelope portion as said enclosure portion covers.

6. The method of claim 1 wherein the manufacturing steps proceed in the same direction of travel throughout the mailing assembly production operation.

7. The method of claim 6 wherein adhesive is applied on said two flap sections of said envelope portion after step f. and before step g.

8. The method of claim 6 wherein in step f. said two flap sections are folded on the same side of the remaining section of said envelope portion as said enclosure portion covers.

9. The method of claim 1 wherein adhesive is applied on said two flap sections of said envelope portion after step f. and before step g.

10. The method of claim 1 wherein in step f. said two flap sections are folded on the same side of the remaining section of said envelope portion as said enclosure portion covers.

11. The method of claim 10 wherein adhesive is applied to said two folded flap sections after step f. and before step g.

12. An improved high speed method for producing a plurality of mailing assemblies each assembly comprised of an envelope and an enclosure consisting of the following steps:

a. providing a plurality of blanks of sheet material each blank comprised of an envelope portion and an enclosure portion;

b. perforating each blank to form a perforated line that divides said envelope portion from said enclosure portion;

c. folding said enclosure portion of each blank upon said envelope portion of said blank to form a double thickness of sheet material with said enclosure portion substantially covering said envelope portion;

d. applying adhesive on a predetermined area of said envelope portion;

e. separating said enclosure portion from said envelope portion to form two discrete pieces and retaining said double thickness of material;

f. scoring said enclosure portion with one scoreline and said envelope portion with four scorelines; and g. folding said double thickness of sheet material to form an envelope assembly having an enclosure.

13. The method of claim 12 wherein the manufacturing steps proceed in the same direction of travel.

14. The method of claim 12 wherein said envelope portion has two side flaps that are folded after step e. and before step f.

15. The method of claim 14 wherein adhesive is applied to said two folded flap sections after the folding step of claim 14 and before step f.

* * * * *